US006782710B2

(12) United States Patent
Eveland et al.

(10) Patent No.: US 6,782,710 B2
(45) Date of Patent: Aug. 31, 2004

(54) KID'S ZONE COMPARTMENT ASSEMBLY FOR A REFRIGERATOR

(75) Inventors: Michael J. Eveland, Cedar Rapids, IA (US); Tamara Kappler, Cedar Rapids, IA (US); Todd E. Kniffen, Williamsburg, IA (US); Timothy M. Nugent, Venice, CA (US); David J. Olberding, Cedar Rapids, IA (US); Robert Pohl, Walford, IA (US); Ravi K. Sawhney, Calabasas, CA (US); Eric Svenby, Sigourney, IA (US); Dennis E. Winders, Cedar Rapids, IA (US); John Frank Zinni, Capistrano Beach, CA (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 10/195,447

(22) Filed: Jul. 16, 2002

(65) Prior Publication Data

US 2004/0011075 A1 Jan. 22, 2004

(51) Int. Cl.[7] ..... F25D 11/02; A47B 96/04
(52) U.S. Cl. ..... 62/441; 312/404
(58) Field of Search ..... 62/441; 312/401, 312/404

(56) References Cited

U.S. PATENT DOCUMENTS

| | | | | | |
|---|---|---|---|---|---|
| 5,209,082 | A | * | 5/1993 | Ha | 62/265 |
| 5,765,390 | A | * | 6/1998 | Johnson et al. | 62/441 |
| 5,951,134 | A | * | 9/1999 | Braun et al. | 312/405.1 |
| 6,055,823 | A | * | 5/2000 | Baker et al. | 62/265 |
| 6,074,030 | A | * | 6/2000 | Prunty et al. | 312/404 |
| 6,085,542 | A | * | 7/2000 | Johnson et al. | 62/441 |
| 6,574,984 | B1 | * | 6/2003 | McCrea et al. | 62/449 |

* cited by examiner

*Primary Examiner*—William C. Doerrler
(74) *Attorney, Agent, or Firm*—Diederiks & Whitelaw, PLC

(57) ABSTRACT

A kid's zone compartment assembly for a refrigerator includes a compartment frame, a top tray, a cover for the top tray, a lower tray, and two tall package retainers. The top tray cover is pivotally hinged to the top tray. The cover is molded and configured in the likeness of a character, particularly an animal caricature. The various compartment components are carried by the compartment frame which, in turn, is supported by a fresh food compartment door liner of the refrigerator. The overall assembly defines a special place for the storage of food items dedicated for access by a child.

20 Claims, 5 Drawing Sheets

KID'S ZONE COMPARTMENT ASSEMBLY FOR A REFRIGERATOR

BACKGROUND OF THE INVENTION

1. Field of the Invention

The present invention pertains to the art of refrigerators and, more particularly, to the incorporation of a specialty zone in a refrigerator dedicated for storing and making accessible food products for kids.

2. Discussion of the Prior Art

In a refrigerator, it is highly desirable to enhance the ability to store products within a limited space. This space includes the inner surfaces of both the fresh food and freezer doors of the refrigerator, with these surfaces typically being defined;by respective door liners. To this end, it is common to provide shelves, bins and/or compartments on these inner surfaces. In recent years, some emphasis has been placed on increasing the ability to store a wide range of products, particularly on the door of the fresh food compartment, in order to free up space in the main compartment areas for additional products. For example, in the recent past, provisions have been made to store rather large beverage containers, including gallon milk cartons and the like, on the fresh food compartment door.

There are certainly many benefits which can be realized by making healthy snacks and other food products readily available to children. Of course, many of the healthiest snacks and other food products geared toward children must be refrigerated. Unfortunately, these refrigerated products are typically not made readily available to children. That is, although a parent would generally prefer a child to eat more nutritional food items, the food items are not often stored in a manner which would enable a child to get a particular food item without assistance. For instance, the food item in question might be on an upper shelf or hidden behind other food items within a refrigerator, thereby not being readily available to a child. For this reason, it is often found that a child will simply elect to eat a food item which is more readily available and, most likely, less nutritional.

It is also often the case that parents would prefer their kid(s) to eat healthy foods which, unfortunately, may not be particularly appealing to the child. Therefore, it is often necessary for a parent to actually entice a child to eat certain types of foods over others. In addition to making the preferential food readily available, the food must be appealing. To this end, it would be desirable to provide a specialty storage area or zone in a refrigerator where food items purchased for a child can be stored in a location which is readily accessible. In addition, it would be ideal to configure the storage zone in a manner which not only entices a child to the food stored there, but also specifically directs a child's attention to the proper zone. In this way, a parent can make desirable food products for a child readily accessible and the child will know exactly where to look for an approved snack or the like.

SUMMARY OF THE INVENTION

The present invention is directed to a kid's zone compartment assembly for a refrigerator which defines a special place for the storage of food items dedicated for access by a child. In accordance with a preferred embodiment of the invention, the overall specialty compartment assembly includes a compartment frame, a top tray, a cover for the top tray, a lower tray, and two tall package retainers. The top tray cover is pivotally hinged to the top tray. The cover is molded and configured in the likeness of a character, particularly an animal caricature. The various compartment components are carried by the compartment frame which, in turn, is supported by a fresh food compartment door liner of the refrigerator.

In accordance with the most preferred embodiment of the invention, the compartment frame mounts to a lower portion of the door liner via molded lugs on the compartment, wherein the overall kid's zone compartment assembly is removable from the door liner. More specifically, the lower tray of the kid's zone compartment assembly hooks and snaps into place in a lower portion of the frame. The tall package retainers, which are molded and preferably colored to depict a character's feet, can be slid over a front flange of the lower tray.

With this construction and mounting, the entire kid's zone compartment assembly of the invention is made readily available to a child. In addition, by presenting the compartment in the form of an animated or other character, a child will be enticed to access the compartment and the food stored therein. In this manner, a parent can maintain preselected, nutritional food products in a specialty compartment dedicated for and accessible by a child. Furthermore, the specialty compartment can be readily removed from the refrigerator door liner for cleaning or interchanging the overall compartment storage arrangement with alternative storage shelves, bins or the like, particularly when all the children in a particular household mature.

Additional objects, features and advantages of the present invention will become more readily apparent from the following detailed description of a preferred embodiment when taken in conjunction with the drawings, wherein like reference numerals refer to corresponding parts in the several views.

DETAILED DESCRIPTION OF THE PREFERRED EMBODIMENT

Figure 1:
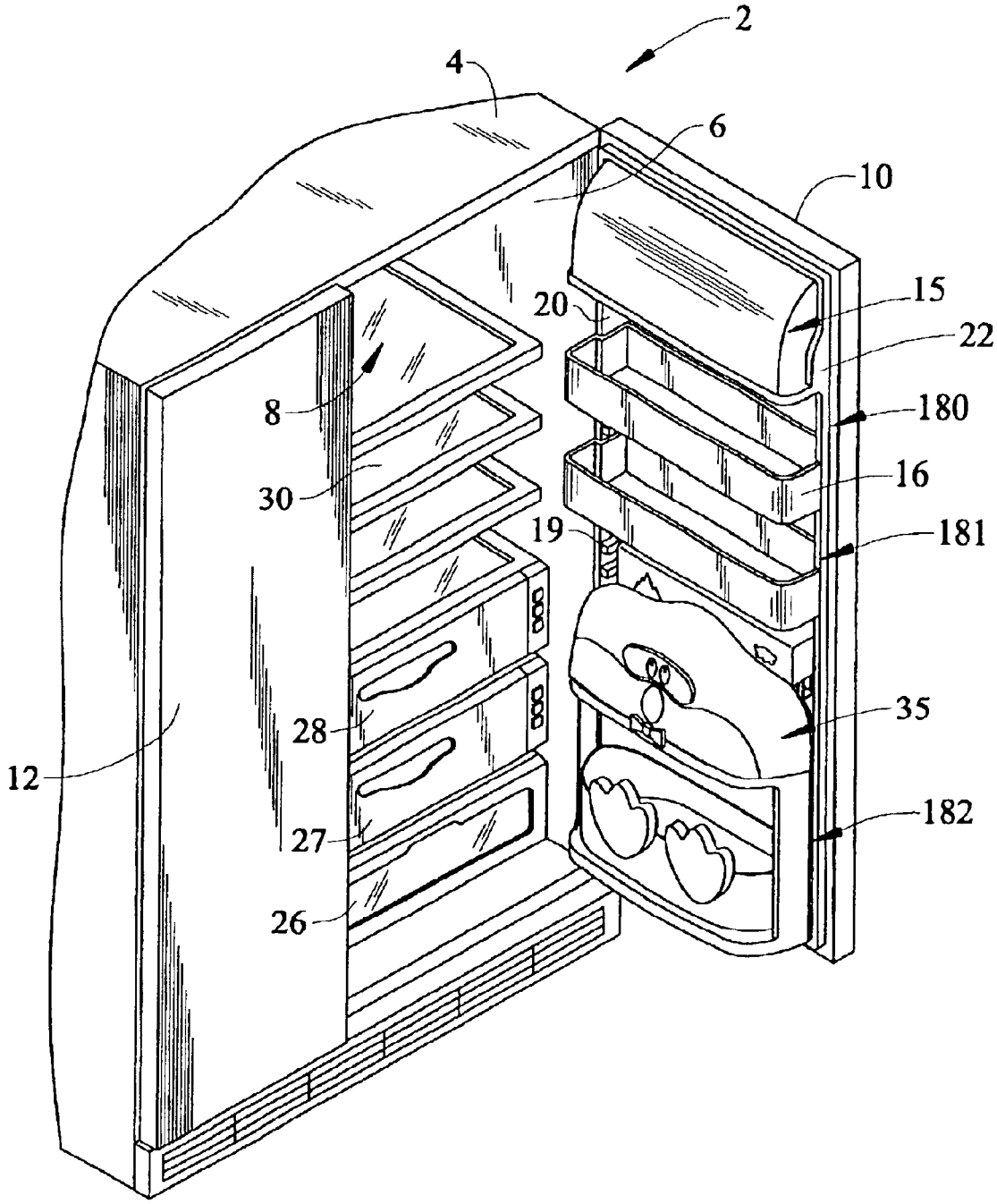
FIG. 1 is a partial, front perspective view of a side-by-side refrigerator incorporating a kid's zone compartment assembly constructed in accordance with the present invention.

With initial reference to FIG. 1, a refrigerator cabinet 2 includes a shell 4 within which is positioned a liner 6 that defines a fresh food compartment 8. In a manner known in the art, fresh food compartment 8 can be accessed by the selective opening of a fresh food door 10. In a similar manner, a freezer door 12 can be opened to access a liner defined freezer compartment (not shown). For the sake of completeness, door 10 of refrigerator cabinet 2 is shown to include a dairy compartment 15 and various vertically adjustable shelving units, one of which is indicated at 16. Shelving units 16 are preferably, removably supported on rails 19 which are integrally molded on opposing inner dike portions 20 of a door liner 22. At a lowermost portion of fresh food compartment 8 is illustrated various slidable bins, i.e., a lowermost bin 26 and higher, individual temperature controlled bins 27 and 28. Above bins 26–28 are preferably arranged in a plurality of planar shelves 30.

Figure 2:
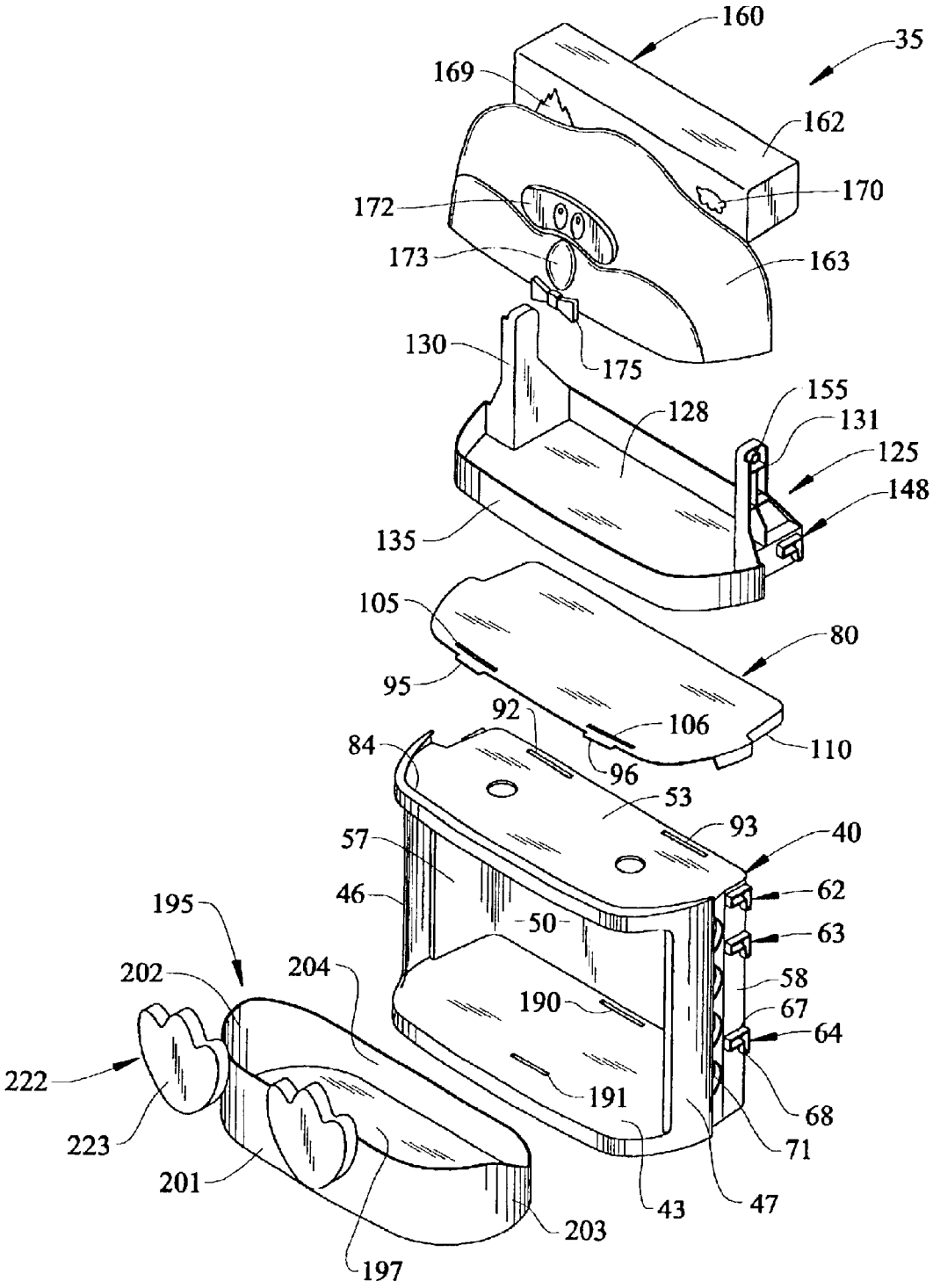
FIG. 2 is an exploded perspective view of the kid's zone compartment assembly of FIG. 1.
Figure 3:
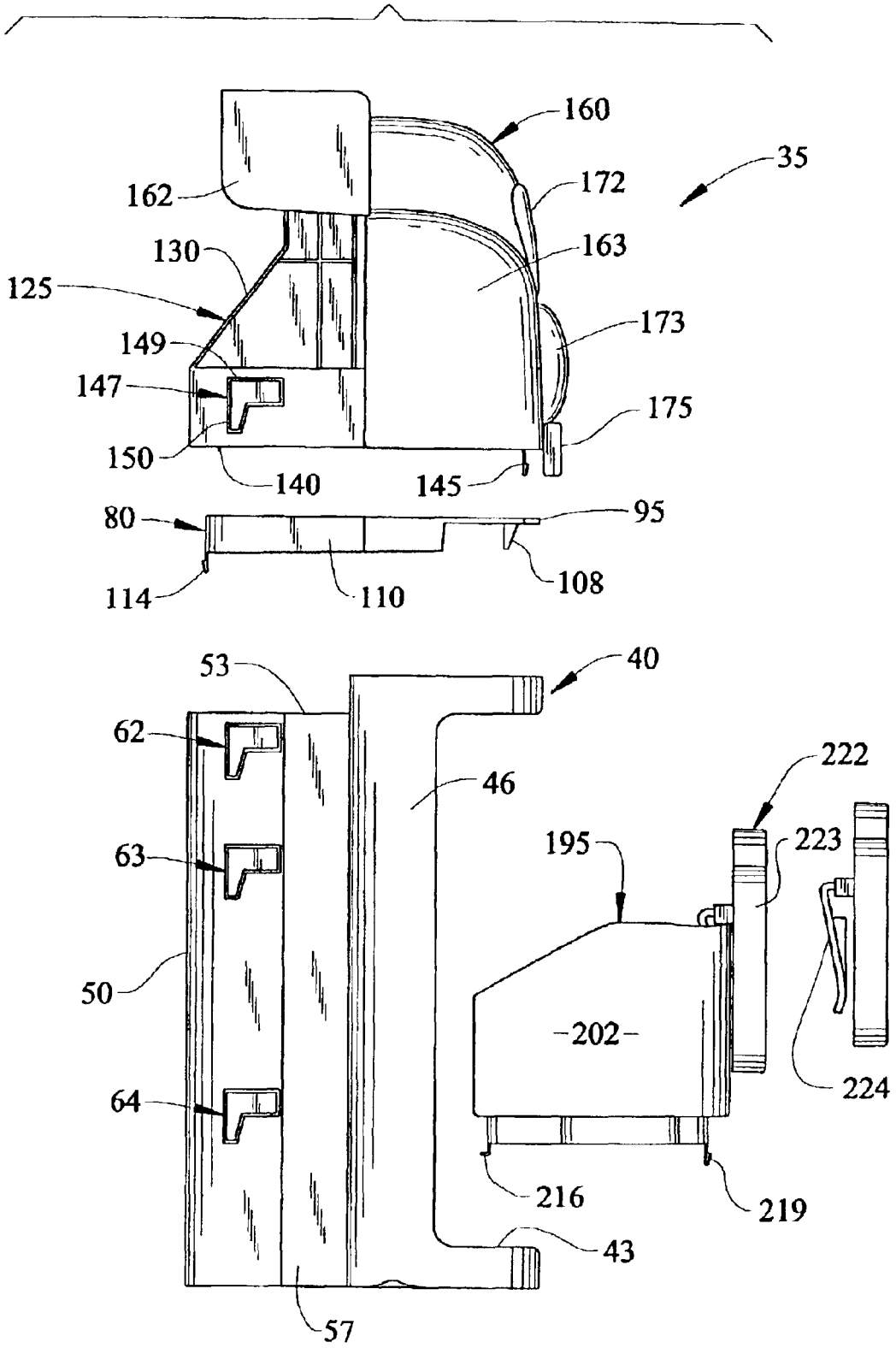
FIG. 3 is an exploded elevational side view of the kid's zone compartment assembly of FIG. 1.
Figure 4:
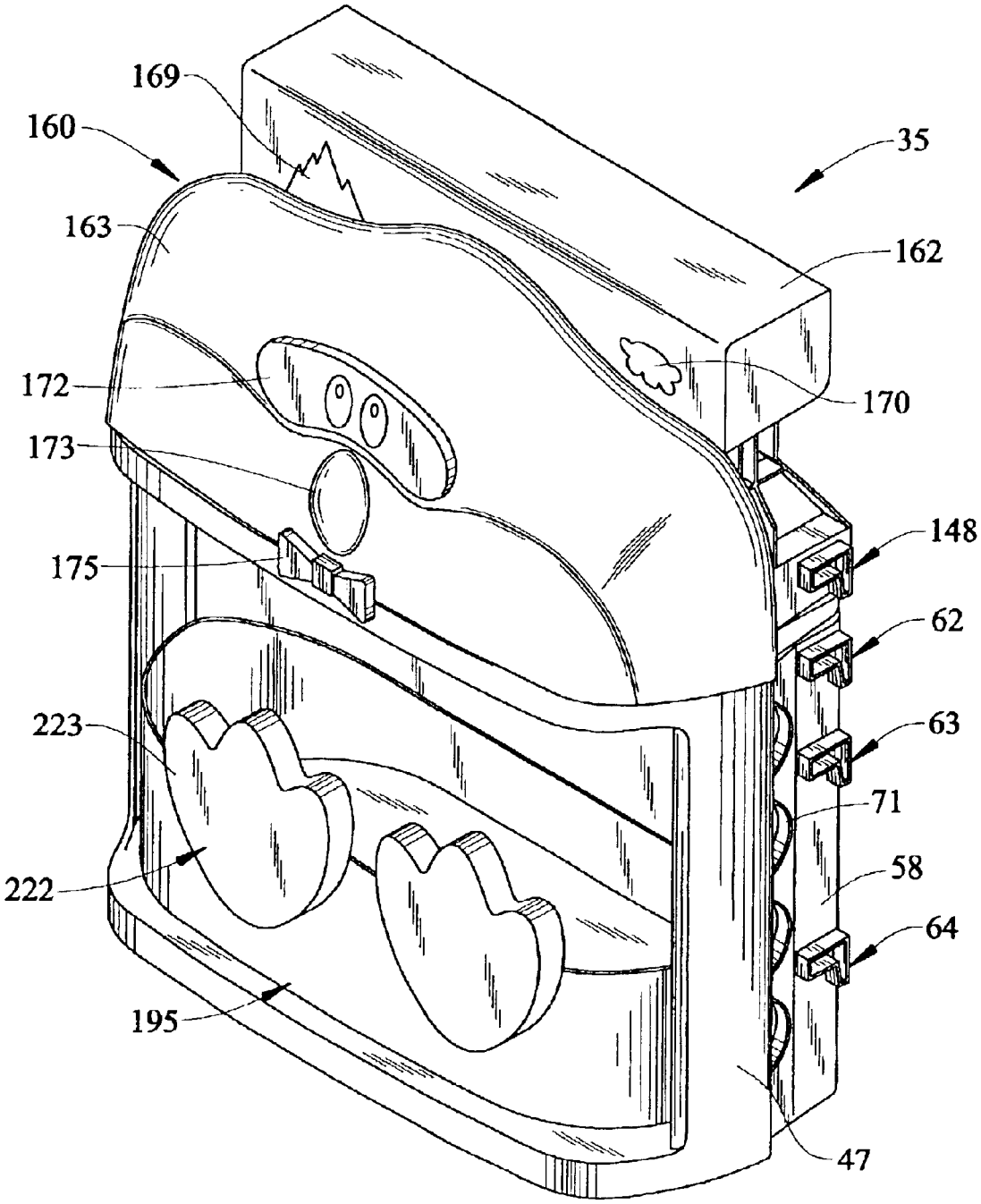
FIG. 4 is an enlarged, perspective view of the kid's zone compartment assembly of FIG. 1.

To this point, the above-described structure is known in the art and presented only for the sake of completeness. This structure is actually more fully described in U.S. Pat. No. 6,170,276, which is incorporated herein by reference. The present invention is actually directed to a removable, kid's zone compartment assembly which is generally indicated at 35. With particular reference to FIGS. 2–4, the preferred construction of kid's zone compartment assembly 35 will now be described. In general, compartment assembly 35 includes a compartment frame 40 having a base 43, a pair of first and second upstanding pillars 46 and 47, a rear wall 50, a top wall 53 and side walls 57 and 58. Provided on side walls 57 and 58 are a plurality of vertically spaced lugs 62–64, each of which includes a horizontal portion 67 and a vertical portion 68. Also provided on side wall 58 are a plurality of vertically spaced, semi-circular apertures 71 which extend entirely through side wall 58. Apertures 71 are actually provided for potential air flow purposes, as will be discussed more fully below. In the most preferred form of the invention, the entire compartment frame 40 is integrally molded of plastic.

Compartment assembly 35 also includes a top cover 80 which is adapted to be attached atop compartment frame 40. More specifically, compartment frame 40 includes an undercut, frontal brim 84, as well as a pair of rear slots 92 and 93 in top wall 53. On the other hand, top cover 80 includes a pair of frontal tabs, 95 and 96 projecting forwardly therefrom. Arranged adjacent tabs 95 and 96 are a pair of spaced, frontal slots 105 and 106. Projecting downward from top cover 80 is one or more frontal support legs 108. About rear and aft side portions (not separately labeled) of top cover 80 is provided a downwardly extending flange 110. Projecting from beneath top cover 80 is also a pair of tapered, flexible tabs, one of which is shown in FIG. 3 at 114. With this construction, top cover 80 is adapted to be secured atop compartment frame 40 with tabs 95 and 96 being positioned beneath undercut brim 84, while flexible tabs 114 are snap-fit within slots 92 and 93 respectively. At the same time, downwardly extending support legs 108 and flange 110 rest upon top cover 80.

Compartment assembly 35 also includes a first tray 125 that is preferably defined by a base 128 from which project integrally formed upstanding support members 130 and 131. In addition, first tray 125 is preferably provided with a peripheral, upstanding wall 135. On a lower side of base 128, first tray 125 is provided with a rear, laterally extending bead 140 (see FIG. 3) and, at a frontal lower portion of base 128, a pair of tapered, laterally spaced, flexible tabs, one of which is shown at 145.

First tray 125 is adapted to be snap-connected to top cover 80 with flexible tabs 145 being received within slots 105 and 106 respectively. As also shown, first tray 125 is preferably formed with side lugs 147 and 148. Each side lug 147, 148 is similarly constructed to lugs 62–64 so as to include a horizontal portion 149 and a vertical portion 150. In a similar manner to lugs 62–64, lugs 147 and 148 are adapted to be supported upon respective rails 19 formed as part of door liner 22.

Extending outwardly from an upper end of each upstanding support member 130, 131 is a respective circular projection 155. Compartment assembly 35 also includes an integrally molded tray cover 160 having an upper rear portion 162 and a frontal portion 163. Upper rear portion 162 is preferably provided with a pair of laterally spaced inner sockets (not shown) into which a respective projection 155 is adapted to extend. In this manner, tray cover 160 is pivotally attached to first tray 125 between a lowered, closed position (see FIGS. 1 and 4) and a raised, open position (see FIG. 5).

In accordance with the present invention, kid's zone compartment assembly 35 is preferably molded and configured in the likeness of a character, particularly an animal caricature. In this most preferred form of the invention shown, compartment assembly 35 takes on the likeness of a penguin. To this end, upper rear portion 162 of tray cover 160 is preferably provides a background as indicated by the depiction of a mountain at 169 and a cloud at 170. On the other hand, frontal portion 163 is provided with an eye zone 172, a nose or beak 173 and a bow tie 175. With this arrangement, kid's zone compartment assembly 35 defines a special, appealing place for the storage of food items dedicated for access by a child. Therefore, the positioning of compartment assembly 35 is important in accordance with the invention as food items stored therein must be readily accessible to a child. To this end, liner 22 of fresh food door 10 generally defines upper, central and lower liner portions 180–182, with compartment assembly 35 being mounted in the lower liner portion 182. More specifically, kid's zone compartment assembly 35 is removably supported within lower liner portion 182, with lugs 62–64, 147 and 148 being supported upon and extending around portions of respective rails 19. Of course, it should be recognized that compartment assembly 35 is generally supported in a manner corresponding to shelving unit 16 which, in turn, is known in the art.

As also clearly shown in these figures, base 43 of compartment frame 40 is preferably provided with a rear slot 190 and front slot 191. In addition, compartment assembly 35 includes a second tray 195 having a bottom 197 and frontal, side and aft walls 201–204. Second tray 195, which is also preferably integrally molded of plastic, is provided with a rear undercut flange 216, as well as a frontal, tapered, flexible tab 219. With this arrangement, second tray 195 is adapted to be removably attached to base 43 with rear undercut flange 216 being initially received within rear slot 190 followed by downwardly pivoting of a frontal portion (not separately labeled) of second tray 195 to cause flexible tab 219 to be snap-fittingly received within front slot 191.

Figure 5:
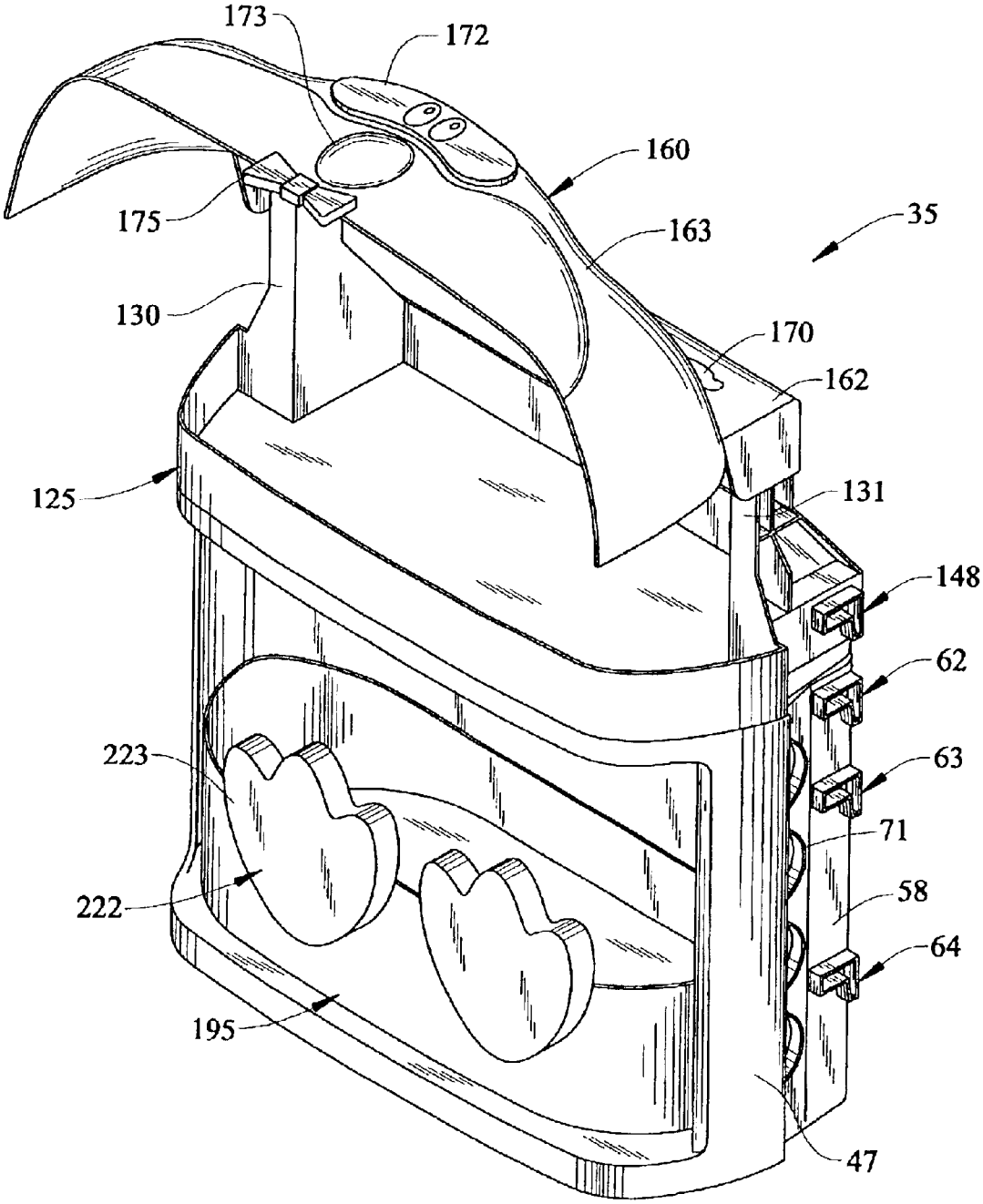
FIG. 5 is a perspective view of the kid's zone compartment assembly, similar to that of FIG. 3, but illustrates a hinged top tray cover of the compartment pivoted to an open position.

Given the space between bottom 197 of second tray 195 and top wall 53, rather tall packages can be supported in second tray 195. In order to prevent any such tall packages from tipping over and out of second tray 195 upon opening and/or closing of fresh food door 10, compartment assembly 35 preferably incorporates a pair of identical, tall package retainers, one of which is indicated at 222. Each retainer 222 is preferably defined by a foot portion 223 and a rear clip portion 224. Clip portion 224 is spaced from foot portion 223 such that tall package retainer 222 can be mounted upon front wall 201 of second tray 195. More specifically, each tall package retainer 222 is preferably slideably mounted along frontal wall 201 in order to enable retainers 222 to be effectively positioned in front of any tall containers or other packages placed on bottom 197. At the same time, retainers 222 preferably take the form of feet for the overall penguin caricature. FIG. 4 shows the overall kid's zone compartment assembly 35 fully assembled, with tray cover 160 in a lowered or closed condition. On the other hand, FIG. 5 shows compartment assembly 35 assembled, but with tray cover 160 in an open position wherein upper rear portion 162 abuts upstanding support members 130 and 131 to limit the permissible degree of pivoting of tray cover 160.

As indicated above, each of compartment frame 40, top cover 80, first tray 125, and second tray 195 of kid's zone compartment assembly 35 is preferably molded of plastic. On the other hand, each foot portion 223 of tall package retainer 222 is preferably formed of rubber, while clip portion 224 is actually made of plastic. As discussed above, first tray 125 is preferably snap-fit to top cover 80 in a manner which maintains first cover 125 securely in place during use, but which affords removal of first tray 125 from top cover 80 and compartment frame 40. In a similar manner, second tray 195 is snap-fit onto base 43 in a manner which enables removal thereof for cleaning or other purposes. Tray cover 160 enables food items placed on first tray 125 to be generally hidden, while protecting the food items from falling off first tray 125 upon opening and closing of fresh food door 10. Of course, tray cover 160 can be readily pivoted relative to and is removable with first tray 125.

Although described with reference to a preferred embodiment of the invention, it should be readily understood that various changes and/or modifications can be made to the invention without departing from the spirit thereof. In general, with this construction and mounting, kid's zone compartment assembly 35 is readily available and enticing to children. In addition, the overall compartment assembly 35 can be readily assembled from various components that can be snap-fit together, while enabling the overall assembly to be removed from door liner 22 in either pieces or as a single unit. Since compartment assembly 35 is dedicated for use by children, it is also considered desirable in accordance with the present invention to enable removal of the entire compartment assembly 35 for cleaning or even loading/unloading purposes. Furthermore, given the rather long life span of a refrigerator, compartment assembly 35 can be readily removed, as the children grow up and certain components thereof replaced with other bins, shelves or the like. For instance, tray cover 160 and retainers 222 could be removed and/or replaced. In this case, compartment assembly 35 could be vertically repositioned for use by taller individuals. Second tray 195 could also be removed and even replaced by one or more doors. In addition, one or more of apertures 71 could be effectively aligned with inlet air flow passages (not shown), fluidly communicating the freezer with fresh food compartment 8, upon the closing of fresh food door 10. However, these potential modifications are not actually considered pertinent to the present invention. In general, the invention is only intended to be limited by the scope of the following claims.

What is claimed is:

1. In a refrigerator including a cabinet within which is defined a fresh food compartment and a freezer compartment, with the fresh food and freezer compartments being selectively accessed by opening respective pivotally mounted doors including inner door liners, each having upper, central and lower liner portions, upon which food products are adapted to be supported, a specialty kid's zone compartment assembly comprising:

a compartment frame;

a first tray supported by the compartment frame and including a frontal portion, said first tray being adapted to support food products placed thereon; and a tray cover movable between open and closed positions wherein, when the cover is in the open position, direct access to the first tray is available and, when in the closed position, the tray cover extends across the frontal portion of the first tray, wherein the kid's zone compartment assembly is configured to resemble an animated figure so as to appeal to children and is removably attached to the lower portion of the fresh food compartment liner so as to be readily accessible by children.

2. The kid's zone compartment assembly according to claim 1, wherein the cover is pivotally hinged to the first tray.

3. The kid's zone compartment assembly according to claim 1, wherein the tray cover is molded to define the animated figure.

4. The kid's zone compartment assembly according to claim 3, wherein the animated figure represents a penguin.

5. The kid's zone compartment assembly according to claim 1, further comprising: a second tray supported by the compartment frame, said second tray being adapted to support food products placed thereon.

6. The kid's zone compartment assembly according to claim 5, further comprising: a pair of tall package retainers, said retainers being attached to the second tray.

7. The kid's zone compartment assembly according to claim 6, wherein the second tray includes a front wall, said retainers being slidably mounted on the font wall such that the retainers can be positioned in front of a tall package placed on the second tray in order to prevent the tall package from tipping off the second tray upon opening and closing of lice door for the fresh food compartment.

8. The kid's zone compartment assembly according to claim 7, wherein the retainers take the form of feet of the animated figure.

9. The kid's zone compartment assembly according to claim 8, wherein the retainers are formed of rubber.

10. The kid's zone compartment assembly according to claim 1, wherein the compartment frame includes a base, first and second upstanding side pillars, and a rear wall.

11. The kid's zone compartment assembly according to claim 10, wherein the base, first and second upstanding side and a rear wall are integrally molded of plastic.

12. The kid's zone compartment assembly according to claim 10, wherein the base extends between and is interconnected between each of the side pillars and the rear wall, said compartment frame further including a top wall extending between and interconnecting the side pillars and the rear wall.

13. The kid's zone compartment assembly according to claim 12, wherein the compartment frame further comprises a top cover positioned above the top wall.

14. The kid's zone compartment assembly according to claim 13, wherein the top cover is snap-fit atop the top wall.

15. The kid's zone compartment assembly according to claim 14, wherein the first tray is snap-fit to the top cover.

16. The kid's zone compartment assembly according to claim 10, further comprising: a second tray supported by the compartment frame, said second tray being adapted to support food products placed thereon, wherein the second tray is snap-fit to the base.

17. The kid's zone compartment assembly according to claim 12, further comprising: a plurality of lugs provided on the compartment frame at vertically spaced positions, said compartment frame being removably supported on the door liner of the fresh food compartment by the plurality of lugs.

18. The kid's zone compartment assembly according to claim 1, wherein the fist tray includes a pair of spaced upstanding support members, said tray cover being hingedly attached to the support members.

19. The kid's zone compartment assembly according to claim 18, wherein the tray cover includes an upper portion, with the upper portion abutting at least one of the support members upon opening the tray cover so as to limit a permissible degree of pivoting of the tray cover relative to the first tray.

20. In a refrigerator including a cabinet within which is defined a fresh food compartment and a freezer compartment, with the fresh food and freezer compartments being selectively accessed by opening respective pivotally mounted doors including inner door liners, each having upper, central and lower liner portions, upon which food products are adapted to be supported, a specialty kid's zone compartment assembly comprising:

a compartment frame adapted to support food products placed thereon, wherein the kid's zone compartment assembly is configured to resemble an animated figure so as to appeal to children and is directly, removably attached to the lower portion of the fresh food compartment liner so as to be readily accessible by children.

* * * * *